US005841237A

United States Patent [19]

Alton

[11] Patent Number: 5,841,237

[45] Date of Patent: Nov. 24, 1998

[54] PRODUCTION OF LARGE RESONANT PLASMA VOLUMES IN MICROWAVE ELECTRON CYCLOTRON RESONANCE ION SOURCES

[75] Inventor: Gerald D. Alton, Kingston, Tenn.

[73] Assignee: Lockheed Martin Energy Research Corporation, Oak Ridge, Tenn.

[21] Appl. No.: 892,492

[22] Filed: Jul. 14, 1997

[51] Int. Cl.[6] ..... H05H 1/00

[52] U.S. Cl. ..... 315/111.81; 315/111.21; 315/111.31

[58] Field of Search ..... 315/111.21, 111.31, 315/111.41, 111.51, 111.61, 111.01, 111.71, 111.81

[56] References Cited

U.S. PATENT DOCUMENTS

| | | | |
|---|---|---|---|
| 5,321,222 | 6/1994 | Bible et al. | 219/745 |
| 5,506,475 | 4/1996 | Alton | 315/111.41 |
| 5,521,360 | 5/1996 | Johnson et al. | 219/709 |

OTHER PUBLICATIONS

R. A. Dandl et al "Electron Cyclotron Heated 'Target' Plasma Experiments," *Plasma Phys. Controlled Nucl. Res.,* (1969), Proc. Intl. Conf., 3rd, Novosibirsk, 435–448.

G. D. Alton et al "Design Studies for an Advanced ECR Ion Source," *Rev. Sci. Instrum.,* 65 (4) Apr. 1994, 775–787.

Z. Q. Xie and C. M. Lyneis, "Improvements on the LBL AECR Source," *Proceedings of Twelfth Intl. Workshop on ECR Ion Sources,* edited by M. Sekiguchi and T. Nakagawa, The Inst. of Physical and Chemical Res. (RIKEN) Apr. 25–27, 1995 Wakoshi, Japan, INS–J–1821995, pp. 24–28.).

*Primary Examiner*—Don Wong
*Assistant Examiner*—David H. Vu
*Attorney, Agent, or Firm*—James M. Spicer

[57] ABSTRACT

Microwave injection methods for enhancing the performance of existing electron cyclotron resonance (ECR) ion sources. The methods are based on the use of high-power diverse frequency microwaves, including variable-frequency, multiple-discrete-frequency, and broadband microwaves. The methods effect large resonant "volume" ECR regions in the ion sources. The creation of these large ECR plasma volumes permits coupling of more microwave power into the plasma, resulting in the heating of a much larger electron population to higher energies, the effect of which is to produce higher charge state distributions and much higher intensities within a particular charge state than possible in present ECR ion sources.

9 Claims, 5 Drawing Sheets

FIG. 1 - Prior Art

PRODUCTION OF LARGE RESONANT PLASMA VOLUMES IN MICROWAVE ELECTRON CYCLOTRON RESONANCE ION SOURCES

The United States Government has rights in this invention pursuant to contract no. DE-AC05-960R22464 between the United States Department of Energy and Lockheed Martin Energy Research Corporation.

FIELD OF THE INVENTION

The present invention relates to the field of microwave electron cyclotron resonance (ECR) ion sources utilizing a B-minimum magnetic mirror confinement geometry. More specifically, it relates to the use of microwave radiation in a variety of forms to increase the physical sizes of the ECR zones in such sources.

BACKGROUND OF THE INVENTION

A conventional single-frequency electron cyclotron resonance (ECR) ion source is shown in FIG. 1. These ion sources have played major roles in the advancement of accelerator technology since their inception. This is because of their capability for generating useful high-intensity, high-charge state ion beams required for many applications. Such ion sources offer a number of major advantages over more conventional hot-cathode ion sources including long source lifetime due to the nonfilamentary cathode structure, operational stability when chemically reactive feed materials are used, and stable operation over a wide dynamical pressure range.

ECR ion sources are designed in accordance with the well-known B-minimum magnetic field confinement principle. In the representative ion source 10 illustrated in FIG. 1, a multimode cavity 11 serves as the plasma confinement vessel. A single-frequency microwave source 17 injects microwave power through a microwave input waveguide 12 into the cavity 11. The feed material of interest is introduced in gaseous or solid form through a feed port 13. Solenoids 8 and 15 act in concert to provide a solenoidal magnetic field for confining the plasma 19 in the axial direction, and a multipole magnet structure 16 provides a multicusp magnetic field for confining the plasma 19 in the radial direction. The two magnetic field distributions are designed so as to effect a minimum in the magnetic field (the B-minimum geometry) as required for optimum plasma confinement. A high potential difference maintained between the source 10 and an electrode system 14 draws the high charge state ion beam 9 from the ion source. The microwave radiation used to generate and maintain the plasma in these sources is typically injected from a single-frequency microwave power supply with a frequency in the range of 2.45 to 14 GHz. The bandwidths of these power supplies are usually quite narrow, typically 20 MHz. Since ion-neutral collisional recombination processes tend to lower the charge state distribution at higher operating pressures, low pressures of about $10^{-6}$ Torr are typically maintained in the plasma chamber 11 of the source.

Electron cyclotron resonance ion sources as shown in FIG. 1 are particularly characterized by the production of a thin three-dimensional electron heating region 18 within the plasma 19 where electrons in the region are accelerated to high energies and then ionize neutral atoms or other ions in the plasma during collisions. The region 18 is usually a thin, fluted, ellipsoidal "surface" which intersects the axis of symmetry of the ion source 10 at two positions, as illustrated in FIG. 1. The ECR region 18 is known by various names including electron cyclotron resonance (ECR) zone, resonant plasma volume, ECR heating zone, ECR surface, etc.

The number density of electrons, the electron energy (temperature), and energy distribution of the electron population are three of the fundamental properties which govern the performance of ECR ion sources in terms of degree of ionization, ion beam intensity, and multiple ionization capabilities. The maximum electron temperature is affected by several processes including the ability of the plasma to adsorb microwaves, the time required to produce "hot" (or energetic) electrons, the time for thermalization of the "hot" electrons and the ability of the source to confine the "hot" electrons. The magnetic field geometry and magnetic field strength determine the confinement attributes of the ECR ion source. Data accumulated over the years clearly indicate that sources with higher confinement fields generate higher charge state ion beams.

The ECR zone or zones in any ECR source are limited to regions of the ionization volume where the magnetic field meets the resonance condition, given by:

$$\omega_{cc}=Be/m=\omega_{rf} \tag{1}$$

where $\omega_{cc}$ is the electron-cyclotron resonant frequency, $\omega_{rf}$ is the resonant frequency of the microwave source, B is the resonant magnetic field strength, e is the electron charge, and m is the mass of the electron. Whenever the microwave frequency is tuned to the electron-cyclotron frequency, electrons are resonantly excited and thereby given sufficient energy to cause ionization within an evacuated volume. At low collision frequencies (low ambient pressures), some of the electrons are stochastically heated to very high energies which are capable of removing tightly bound electrons, and therefore are responsible for producing multiply charged ions.

For a particular microwave frequency, microwave power can no longer be coupled into the plasma whenever the plasma density reaches a certain value, referred to as the critical density $n_c$. The critical density $n_c$ occurs whenever the microwave frequency $\omega_p$ is equal to the plasma frequency $\omega_{rf}$ or $\omega_{rf}=\omega_p$. The relation between the critical density $n_c$ and the plasma frequency $\omega_p$ is given by the following expression:

$$n_c=\omega_p^2\epsilon_0 m/e^2 \tag{2}$$

where $\epsilon_0$ is the permittivity of free space.

Since the ECR condition is met whenever $\omega_{cc}=\omega_{rf}$(Eq. 1), the critical density increases quadratically with the resonant magnetic field strength B. For example, the critical density for 2.45 GHz is $7.45\times10^{10}/cm^3$ while the critical density for a 14 GHz excitation frequency is $2.43\times10^{12}/cm^3$. Under certain conditions, right-hand circularly polarized electromagnetic waves can propagate in a magnetized plasma in the so-called whistler mode, even if the plasma density is above the critical density $n_c$, provided that the microwave frequency is less than the corresponding electron cyclotron frequency and that the waves propagate along the direction of the magnetic field.

The 2.45 GHz ECR microwave source requires a magnetic field strength of 875 Gauss to meet resonance conditions, while the 14 GHz source requires 5000 Gauss fields for resonance to occur. Thus, while low frequency microwave sources have lower cutoff densities and require physically larger plasma chambers for coupling the microwave power, they benefit in terms of emittance degradation by the lower magnetic fields in the extraction region of the ECR ion source. High frequency microwave sources, on the other hand, have the decided benefit of higher cutoff densities and small diameter plasma chambers, but suffer in terms of emittance degradation as a consequence of the strong magnetic fields that exist in the extraction region of the ECR ion source. The emittance is degraded in direct proportion to the magnitude of the field strength in the extraction region of the ECR ion source.

In conventional single frequency ECR ion sources (FIG. 1), the shapes, physical sizes, and locations of the ECR zones 18 are determined by the frequency and bandwidth of the microwave power and the magnitude and distribution of the magnetic field which meets the ECR condition (Eq. 1). The magnetic field distribution used in traditional ECR ion sources 10 confines the plasma effectively, but severely restricts the physical sizes of the ECR or "hot" zones in relation to the total size of the ionization volume. Because these ECR "surfaces" are small in relation to the physical size of the ionization chamber, the ECR zones constitute a small fraction of the ionization volume. Thus, the absorptivity of microwaves by the plasma is determined not by the physical size of the plasma volume but by the size of the ECR zone 18 in the ion source 10. Electrons can only be accelerated in the ECR zone; those which leave the ECR zone through scattering have a reduced probability for further stochastic acceleration because of the reduced probability of returning to the zone, and therefore the probability for further acceleration is reduced. Traditional ECR ion sources 10 with small ECR zones may be more susceptible to these scattering effects which may limit the high energy electron population and thereby limit the ionization rate of the ion source. The remedy of the problem may be found by increasing the relative size of the ECR zone. The creation of a large ECR plasma "volume" would permit coupling of more power into the plasma, resulting in the heating of a much larger electron population to higher energies. As a consequence, the performance of the ECR ion source may be enhanced in terms of charge state and intensity within a charge state over conventional ECR ion sources.

The principal processes which limit high-charge-state ion production in the ECR ion source are through charge exchange, wall recombination, ion residence time in the plasma, the bombarding electron current, the confinement time of the hot electrons, and the electron temperature. Charge-exchange collisions between ions and neutral atoms reduce the degree of ionization and high-charge-state population of the ion source. High-charge-state particles, ionized in the ECR zones of the ion source, must necessarily pass through extended regions of unheated plasma before extraction. As a necessary consequence of the requirement of neutrality in the plasma, there is a dynamical charge balance between electron and ion loss processes. Most of the ions recombine at the radial walls of the vacuum chamber and re-enter the plasma as neutrals while most of the electrons are lost at the ends of the plasma chamber.

Because of the thin ECR surfaces in conventional ECR ion sources, the probability for ionizing a neutral atom during passage through the ECR zone and re-entry into the interior of the plasma volume is believed to be low. Therefore, the population of neutrals is postulated to be greater in the interior of the source than if the ECR zone was of sufficient thickness to ionize the particles with high probability during passage to the interior of the plasma volume. As a consequence, the average charge state of the ion distribution in the plasma would be lowered through charge exchange collisions between the neutrals and multiply-charged ions within the plasma. The ability to quickly ionize a large fraction of the neutral population that results from recombination of the multiply-charged ions which strike the walls of the vacuum chamber effectively reduces the rate of resonant charge exchange. This increases the residence time of an ion in a given charge state, and thereby increases the probability for subsequent and further ionization. If the colliding partners are positively ionized, the long-range forces and relatively low energies reduce the likelihood of charge transfer in these collisions. The ability to eliminate or drastically reduce the charge exchange process increases the lifetime of a charged particle within a particular charge state, thus increasing the probability of further ionization. Therefore, the advantage of having a thick ECR zone between the walls of the chamber and the interior of the plasma where the multiply charged ions are extracted will improve reionization efficiency of neutrals returning from the walls, thereby reducing charge exchange recombination processes within the central plasma region of the ion source.

Large ECR volumes result in significantly greater interaction of the microwaves with the plasma electrons, both in terms of total power absorptivity and in a more uniform spatial distribution of the absorptivity. The presence of a large ECR zone as well as the additional probability of accelerating larger electron populations to higher average energies increases the charge state distributions and ion beam intensities within a particular charge state.

Prior attempts to increase the size of the resonant plasma volume in an ECR ion source have been by 1) tailoring the magnetic field and 2) by heating with two microwave frequencies. Z. Q. Xie and C. M. Lyneis used 10 GHz and 14 GHz microwave frequencies simultaneously to excite the plasma in their Advanced ECR (AECR) ion source at the Lawrence Berkeley Laboratory (see "Improvements on the LBL AECR Source", Z. Q. Xie and C. M. Lyneis, Proceedings of Twelfth International Workshop on ECR Ion Sources, edited by M. Sekiguchi and T. Nakagawa, The Institute of Physical and Chemical Research (RIKEN) Apr. 25–27, 1995, Wakoshi, Japan, INS-J-1821995, p. 24–28.). This resulted in moving the charge states to higher values by 3 to 4 units for bismuth and uranium. The Xie and Lyneis approach is illustrated in FIG. 1 by the additional single-frequency microwave source 17' and waveguide 12'. The waveguide 12' is shown as a different size than waveguide 12 to illustrate that the two rectangular waveguides 12 and 12' are oriented 90 degrees with respect to each other. When operated with the two different frequencies, the ECR interaction surface areas were increased by about a factor of two. As a consequence, the absorptivity of microwave power by the plasma was also increased, making more electrons available for acceleration by the respective RF fields. Electrons which scatter out of a particular ECR zone 18 and cross into the second zone 18' can also be further accelerated. The outer (14 GHz) surface may serve to ionize neutrals which result during charged particle recombination at the walls of the chamber and thus reduce the population of neutrals which would otherwise lower the charge state distribution created in the interior region of the ion source by the action of the 10 GHz ECR surface. The results of Xie and Lyneis' experiments with the AECR serve to point out the importance of the physical sizes of the ECR zones on the performance of ECR ion sources.

SUMMARY OF THE INVENTION

It is an object of the present invention to provide a system for increasing the physical sizes of ECR zones in conventional B-minimum ECR sources by the utilization of diverse frequency microwave power to achieve large ECR volumes within the ECR ion sources rather than by reliance on magnetic field improvements.

Another object of the present invention is to enhance the performance of existing ECR ion sources by generating higher charge state heavy-ion beams with higher intensities within a particular charge state compared to present single- or two-frequency ECR ion sources.

In accordance with a first preferred embodiment of the present invention, there is provided an electron cyclotron resonance (ECR) ion source for producing high charge state high-intensity ion beams, the ion source having a B-minimum magnetic field for confining a plasma, and wherein the plasma is excited by microwaves from a microwave source inputted to the ion source through a waveguide, and also wherein the ion source is operable to produce an electron cyclotron resonance zone of heated plasma electrons within the plasma by absorption of microwaves from the microwave source; the improvement wherein the microwave source is a diverse frequency microwave source for increasing the physical size of the electron cyclotron resonance zone within the plasma, and the waveguide is a broadband waveguide having a bandwidth chosen to fall within the resonant frequency distribution of the magnetic field of the ion source.

In accordance with another preferred embodiment of the present invention, the diverse frequency microwave source comprises a plurality of signal generator and microwave amplifier pairs, each of the signal generator and microwave amplifier pairs operable to produce a discrete microwave frequency and inject same into the broadband waveguide.

In accordance with another preferred embodiment of the present invention, the diverse frequency microwave source comprises a microwave amplifier and a variable frequency signal generator; the microwave amplifier operable to produce microwaves and inject them into the broadband waveguide; and the variable frequency signal generator operable to input a continuously varying frequency signal to the microwave amplifier such that a large volume ECR zone is produced within the plasma.

In accordance with another first preferred embodiment of the present invention, the diverse frequency microwave source comprises a microwave amplifier and a broadband signal generator, the microwave amplifier operable to produce microwaves and inject them into the broadband waveguide; and the broadband signal generator operable to input a broadband frequency signal to the microwave amplifier such that microwaves produced by the microwave amplifier are distributed across the bandwidth of the waveguide.

In accordance with yet another preferred embodiment of the present invention, the diverse frequency microwave source comprises a plasma wave tube (PWT) amplifier, the plasma wave tube amplifier operable to produce microwaves over a wide bandwidth and inject them into the broadband waveguide such that a large volume ECR zone is produced within the plasma resulting in an ion beam with higher charge state ions and higher beam intensities within a particular charge state from the ECR ion source.

DETAILED DESCRIPTION OF THE INVENTION

The ECR ion source improvements described hereinbelow are based on the use of high-power diverse frequency microwaves, especially variable-frequency, multiple-discrete-frequency, and broadband microwaves derived from traveling wave tube (TWT), magnetron, klystron, gyrotron, or plasma wave tube (PWT) technologies, to create large ECR "volumes" in conventional B-minimum ECR ion sources 10.

EMBODIMENT 1

Multiple Discrete Frequencies

Figure 1:
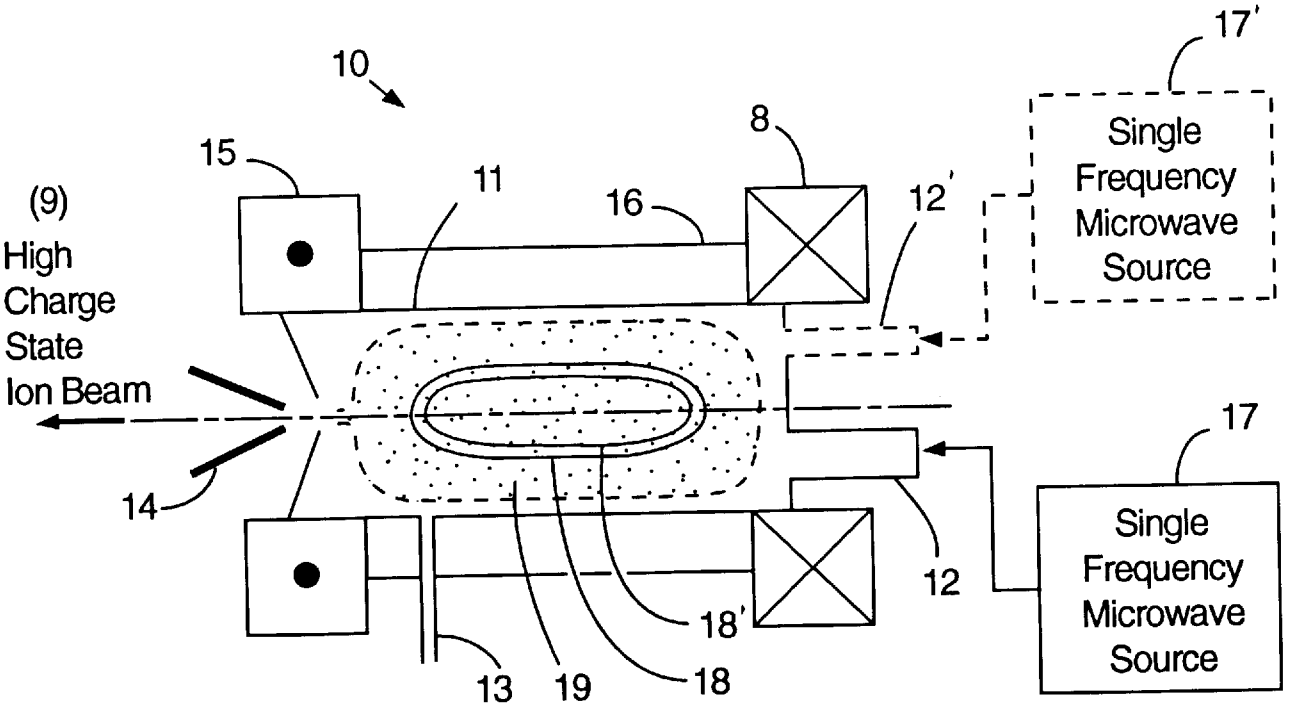
FIG. 1 is a schematic drawing of a conventional microwave ECR ion source, illustrating microwave excitation by means of one or two single-frequency microwave sources.
Figure 2:
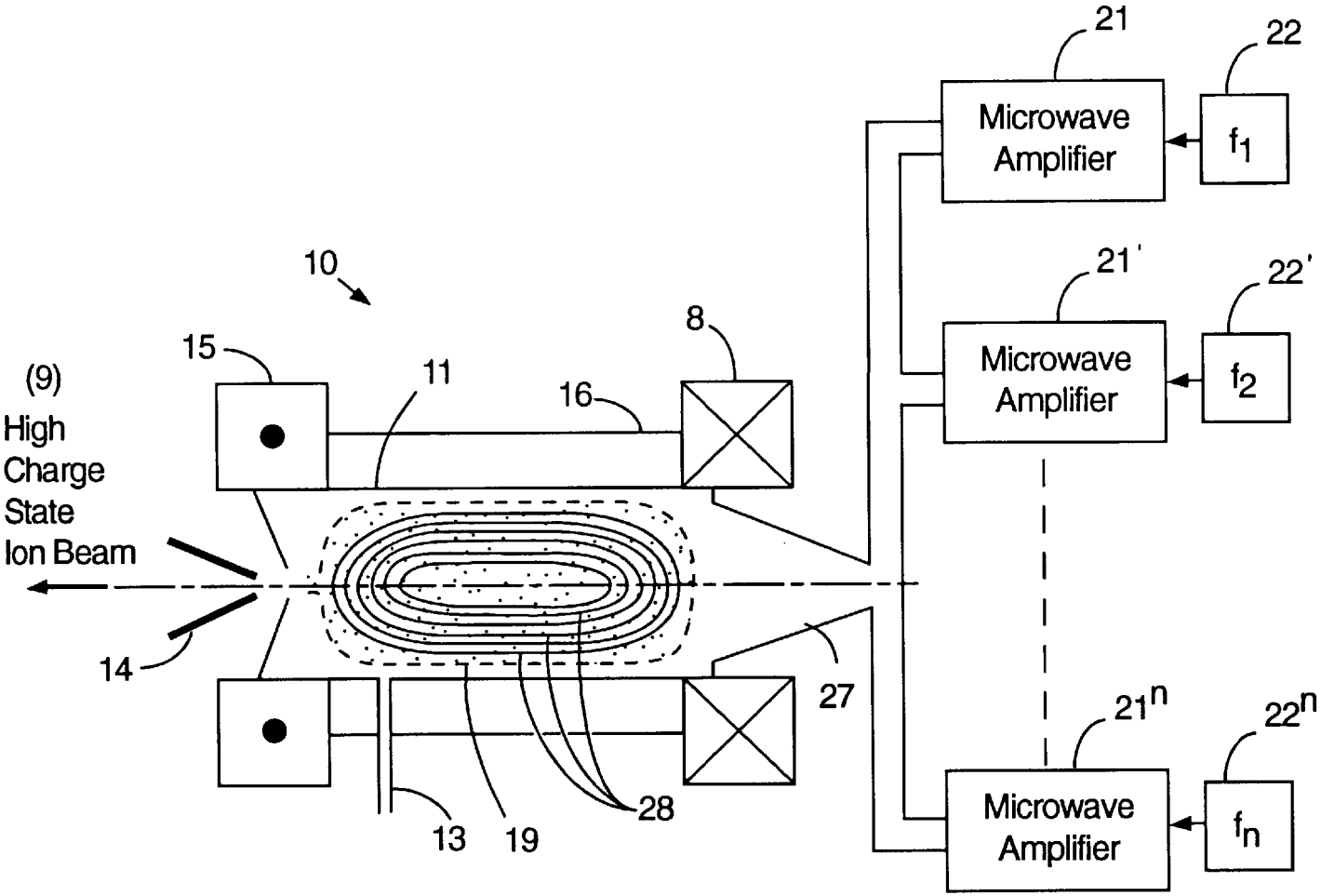
FIG. 2 is the microwave ECR ion source of FIG. 1, showing diverse frequency microwave ECR heating by means of discrete frequency microwave excitation according to a first preferred embodiment of the present invention.

FIG. 2 illustrates a first preferred embodiment of the present invention where the ECR plasma volume is increased by exciting the plasma with microwave power at multiple discrete frequencies. For this embodiment, a plurality of microwave frequencies from individual single-frequency signal generators 22, 22', . . . 22$^n$ etc., are inputted to respective microwave amplifiers 21, 21', . . . 21$^n$ etc. For example, multiple discrete frequencies of 10, 11, 12, 13 and 14 GHz may be selected to fill the bandwidth of the broadband microwave input waveguide 27. Whatever the set of frequencies used, they are chosen to fit into the resonance frequency distribution of the particular ECR ion source 10. This method can be readily effected by using traveling wave tube (TWT) amplifiers or multiple single frequency amplifiers to provide the microwave power for exciting the plasma.

Other sources of microwave radiation including magnetron, klystron, or gyrotron sources could be used just as well for the microwave amplifiers 21, 21', etc. Multiple klystron, magnetron, gyrotron, or combinations of these power sources could also be utilized to achieve the desired larger ECR zones within a given ECR ion source.

The operation of a traveling wave tube is based on the transfer of energy between an electron beam and an RF wave. The transfer can only be efficient if the electron beam and RF wave are traveling at about the same velocity. Since the microwave travels at a velocity about 100 times that of the electron in free space, a helical structure is used in the TWT to slow the wave down so that the velocities are about the same. By directing the electron beam along the axis of the helix, the time-varying electric field on the helix causes the electron beam energy to vary according to the electric field strength. The resulting velocity modulation causes the electron beam to form bunches, and as the bunches move through the helix their sizes grow. The helix senses a time-varying electric field from the electron bunches which induces an RF wave onto the helix of the same frequency as the initial RF wave, but greatly amplified. Power gains up to 70 db (10,000) can be achieved. A single TWT can deliver several hundred watts of RF power.

In more detail of the multiple, discrete frequency method shown in FIG. 2, the signal generators are provided with several discrete frequencies chosen to fill the bandwidth of the broadband waveguide 27. For example, the bandwidth of a WR90 waveguide is designed to transmit a frequency spectrum of 8–12 GHz. A logical choice might be to chose discrete frequencies of 8, 9, 10, 11 and 12 GHz for amplification by the TWT amplifiers 21, 21', etc. As a consequence, the performance of the ion source is improved over that of the single- or two-frequency ECR ion source.

EMBODIMENTS 2 and 3

Variable Frequency

Figure 3:
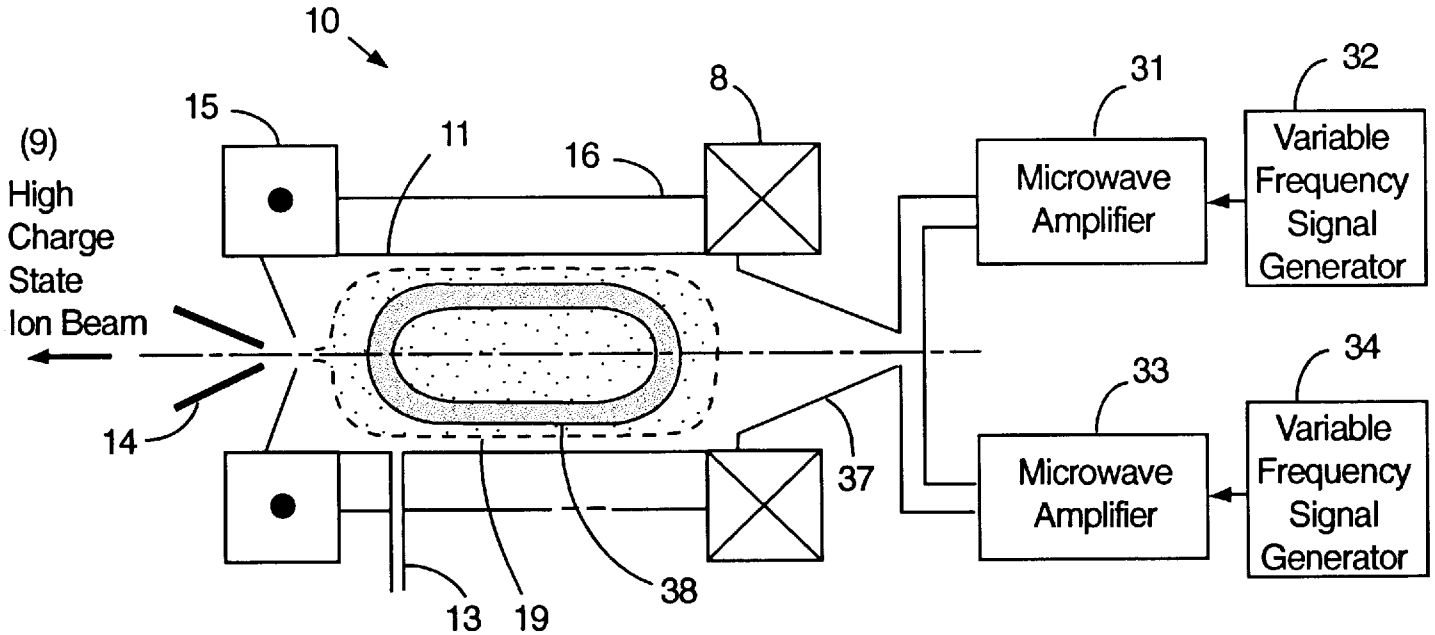
FIG. 3 is the microwave ECR ion source of FIG. 1, showing diverse frequency microwave ECR heating by means of variable frequency microwave excitation according to two further preferred embodiments of the present invention.

In a second preferred embodiment of the invention shown in FIG. 3, a variable frequency signal generator 32 is used in combination with a microwave amplifier 31. The signal generator 32 generates a continuously varying signal which sweeps over a bandwidth matching the bandwidth of the waveguide 37 and the frequency distribution within the B-minimum region of the magnetic field. The frequency is swept through a selected frequency range at a sweep period comparable to or preferably less than the lifetime of the ions within the plasma, (less than 1 ms, for example). Since the sweep rate is less than the estimated confinement time (a few milliseconds) of low charge state particles in an ECR ion source, electrons in the ECR region are accelerated to high energies during the sweep cycles.

Further improvements in the ion source performance may be realized by using two continuously varying frequencies, phased so that one signal begins its sweep from the low side toward the high side of the band and return; while another signal is synchronized to begin its sweep simultaneously with the former, beginning at the high side of the frequency spectrum and decreasing toward the low side and return. Microwave amplifiers 31 and 33, together with their respective variable frequency signal generators 32 and 34, accomplish this.

In a third preferred embodiment of the invention, four or more continuously varying signals may be utilized. For example, if four signal generators are used, two of the signals would be phased 90 degrees with respect to each other, both increasing toward the high frequency side of the sweep range and returning. The remaining two frequencies would be phased 90 degrees with respect to each other and synchronized with the first two beginning at the high side of the frequency range and decreasing toward the lower side and return. The effect of the above-described variable frequency alternatives is to keep the plasma more uniformly ionized and homogeneously distributed within the ECR plasma volume, thus reducing charge state lowering processes through charge exchange. As a consequence, the performance of the ion source is improved over that of the single frequency ECR ion source. As is known in the art of TWT's, the signals from the signal generators 32, 34 may be enhanced in magnitude with voltage controlled pre-amplifiers (now shown) before final amplification by the TWT amplifiers 31, 33.

EMBODIMENT 4

Broadband Frequency

Figure 4:
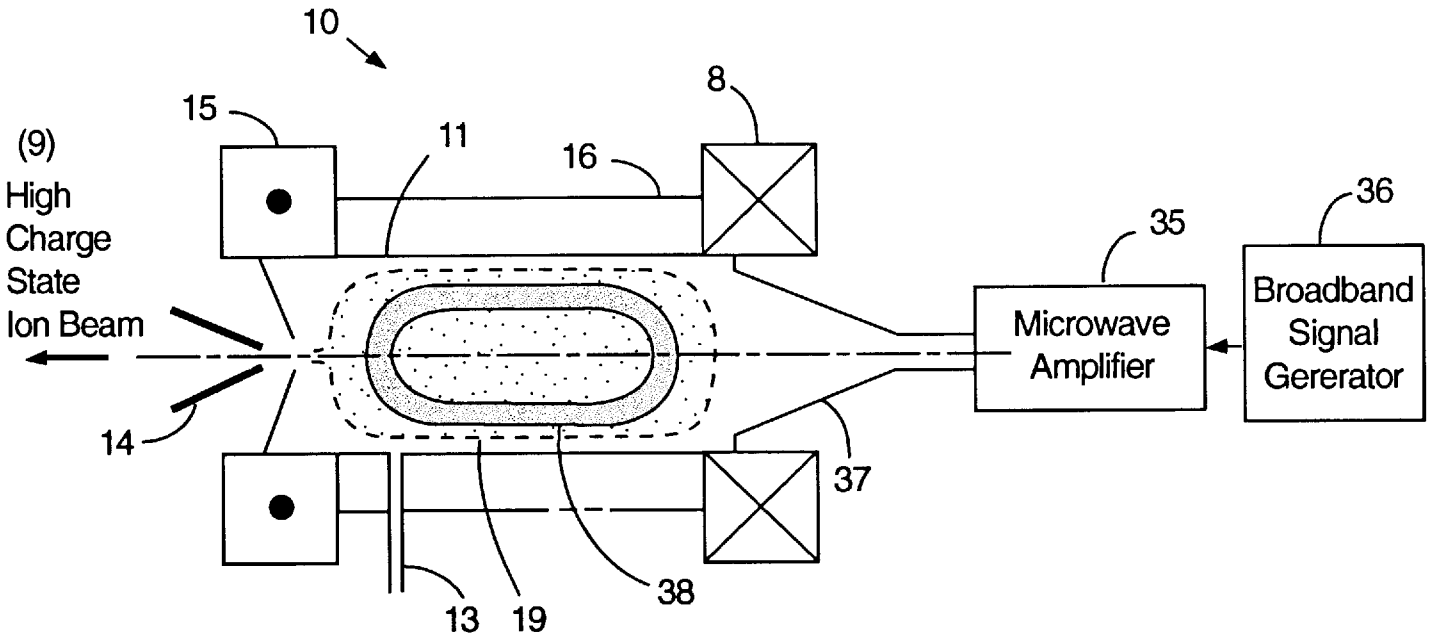
FIG. 4 is the microwave ECR ion source of FIG. 1, showing diverse frequency microwave ECR heating by means of broadband frequency microwave excitation according to a further preferred embodiment of the present invention.

In a fourth preferred embodiment of the invention, shown in FIG. 4, a broadband signal generator 36 provides input to a microwave amplifier 35. The output of microwave amplifier 35 is routed to the vacuum vessel 11 by the broadband waveguide 37. For the broadband method, the signal generator 36 is chosen to be a "noise" generator with a bandwidth compatible to that of the broadband waveguide 37 and the ECR frequency distribution of the B-minimum magnetic field of the ECR ion source 10. As in the other embodiments of the invention, the broadband frequency signal may be pre-amplified by a voltage controlled pre-amplifier (not shown) before final amplification by the TWT amplifier 35 to enhance the power delivered to the B-minimum ECR ion source 10 through the broadband waveguide 37. The broadband power keeps the plasma more uniformly ionized and homogeneously distributed within the broadened ECR plasma volume 33, thus reducing charge-state-lowering processes through charge exchange. As a consequence, the performance of the ion source is improved over that of the single- or two-frequency ECR ion source.

EMBODIMENT 5

Broadband Frequency with a PWT

Figure 5:
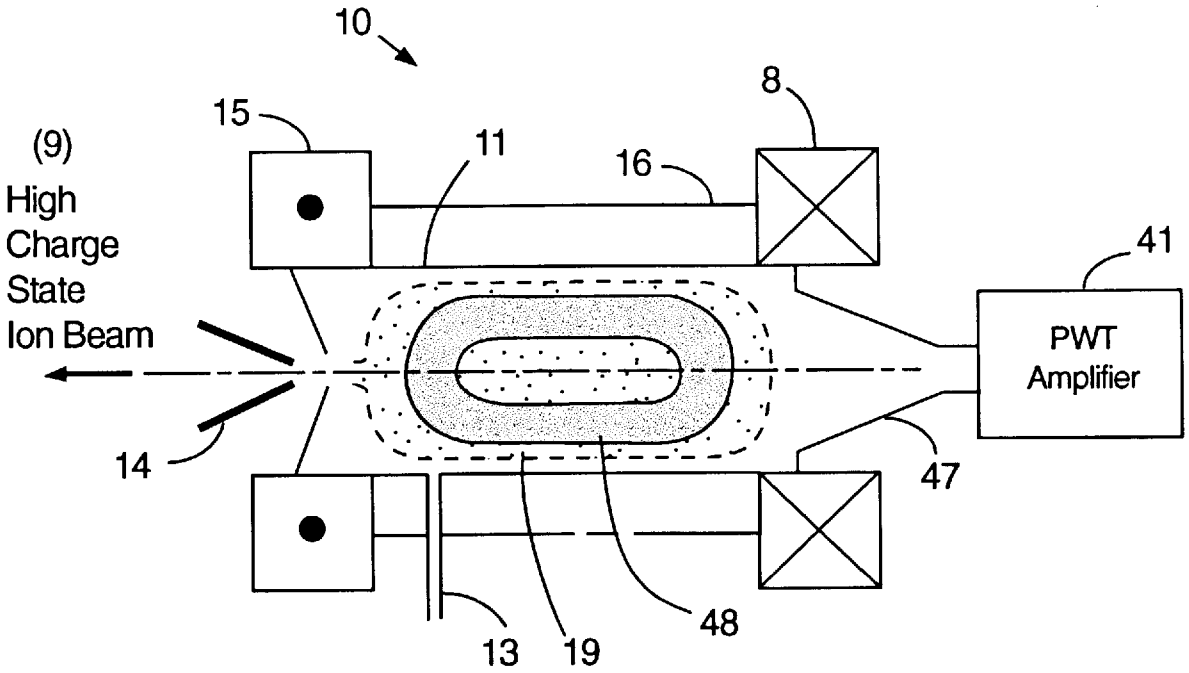
FIG. 5 is the microwave ECR ion source of FIG. 1, showing diverse frequency microwave ECR heating by means of broadband frequency microwave excitation according to a still further preferred embodiment of the present invention.

A fifth preferred embodiment of the invention, shown in FIG. 5, utilizes short-pulse, ultra-broadband RF power generated directly by a plasma wave tube, or PWT, 41. The PWT utilizes the interaction between an electron beam and a time-varying plasma to generate kilowatt levels (~10 kW) of power at microwave to millimeter-wave frequencies. The electron beam from the PWT 41 first ionizes a feed gas to form the plasma 19, and then nonlinearly interacts with the plasma 19 to generate broadband power, for example, from 6 to 60 GHz. Slew rates of up to 7 GHz/ms have been measured during a single beam pulse. The RF power has a wide instantaneous bandwidth, typically 10 GHz or wider.

The various embodiments of the present invention described hereinabove for increasing the sizes of the resonant zones in existing ECR ion sources offer the potential of a cost-effective means for enhancing the performances of these ECR sources. The presence of large ECR zones as well as the additional effect of accelerating much larger electron populations to much higher average lo energies causes ECR ion sources to produce higher charge states and higher ion beam intensities within a particular charge state. Large ECR volumes result in significantly greater interaction of the microwave radiation with the plasma electrons, both in terms of total power absorptivity and in a more uniform spatial distribution of the absorptivity. Since the ECR zones are nearer the axis in all of these frequency domain sources, the high charge state population is born closer to the axis of extraction and therefore can be extracted more efficiently.

Perhaps the most practical aspect of the diverse frequency methods of my invention is that they can be utilized to relatively inexpensively transform present "surface" ECR ion sources into "volume" ECR ion sources. By use of these methods, traditional ECR ion sources that are based on single frequency microwave heating can be converted from resonant "surface" ion sources to resonant "volume" ion sources, thus permitting the coupling of more microwave power into the plasma resulting in the heating of a much larger electron population to higher energies than presently possible in ECR ion sources.

While several preferred embodiments of the improved ECR ion source have been shown and described, it will be understood that such descriptions are not intended to limit the disclosure, but rather it is intended to cover all modifications and alternate methods falling within the spirit and scope of the invention as defined in the appended claims or their equivalents.

I claim:

1. In an electron cyclotron resonance (ECR) ion source for producing high charge state high-intensity ion beams, said ion source having a B-minimum magnetic field for confining a plasma, and wherein said plasma is excited by microwaves from a microwave source inputted to said ion source through a waveguide, and wherein said ion source is operable to produce an electron cyclotron resonance zone to resonantly heat plasma electrons within said plasma by absorption of microwaves from said microwave source;

the improvement wherein said waveguide is a broadband waveguide having a bandwidth chosen to fall within the resonant frequency distribution of the magnetic field of said ion source; and said microwave source comprises a microwave amplifier and a variable frequency signal generator, said microwave amplifier operable to produce microwaves and inject them into said broadband waveguide, and said variable frequency signal generator operable to input a continuously varying frequency signal to said microwave amplifier such that a large volume ECR zone is produced within said plasma.

2. The system of claim 1 wherein said microwave amplifier is a traveling wave tube amplifier.

3. The system of claim 1 further including an additional microwave amplifier and additional variable frequency signal generator, wherein both of said variable frequency signal generators are operated with frequencies phased so as to optimize the charge state distribution of said electron cyclotron resonance ion source.

4. The system of claim 3 wherein both of said variable frequency signal generators are operated with frequencies oppositely phased.

5. The system of claim 1 further including three additional microwave amplifiers and three additional variable frequency signal generators, wherein all four of said variable frequency signal generators are operated with frequencies phased 90 degrees apart so as to optimize the charge state distribution of said electron cyclotron resonance ion source.

6. In an electron cyclotron resonance (ECR) ion source for producing high charge state high-intensity ion beams, said ion source having a B-minimum magnetic field for confining a plasma, and wherein said plasma is excited by microwaves from a microwave source inputted to said ion source through a waveguide, and wherein said ion source is operable to produce an electron cyclotron resonance zone to resonantly heat plasma electrons within said plasma by absorption of microwaves from said microwave source;

the improvement wherein said waveguide is a broadband waveguide having a bandwidth chosen to fall within the resonant frequency distribution of the magnetic field of said ion source; and said microwave source comprises a microwave amplifier and a broadband signal generator, said microwave amplifier operable to produce microwaves and inject them into said broadband waveguide; and said broadband signal generator operable to input a broadband frequency signal to said microwave amplifier such that microwaves produced by said microwave amplifier are distributed across the bandwidth of said waveguide.

7. The system of claim 6 wherein said microwave amplifier is a traveling wave tube (TWT).

8. In an electron cyclotron resonance (ECR) ion source for producing high charge state high-intensity ion beams, said ion source having a B-minimum magnetic field for confining a plasma, and wherein said plasma is excited by microwaves from a microwave source inputted to said ion source through a waveguide, and wherein said ion source is operable to produce an electron cyclotron resonance zone to resonantly heat plasma electrons within said plasma by absorption of microwaves from said microwave source;

the improvement wherein said waveguide is a broadband waveguide having a bandwidth chosen to fall within the resonant frequency distribution of the magnetic field of said ion source; and said microwave source is a broadband microwave source operable to produce microwaves over a wide bandwidth and inject them into said broadband waveguide such that a large volume ECR zone is produced within said plasma resulting in an ion beam with higher charge state ions and higher beam intensities within a particular charge state from said ECR ion source.

9. The system of claim 8 wherein said broadband microwave source is a plasma wave tube (PWT) amplifier.

* * * * *